US007658682B2

(12) United States Patent
Hoium et al.

(10) Patent No.: US 7,658,682 B2
(45) Date of Patent: Feb. 9, 2010

(54) GOLF CLUB HANDLE GRIP WITH BALL MARKER

(76) Inventors: Jason Hoium, 905, 405 - 5th Avenue North, Saskatoon, SK (CA) S7K 6Z3; Brad Wallin, South Residence, Mailbox 510, Univerity of Regina, Regina, SK (CA) S4S 0A2; Drew Krainyk, 905 - 405 - 5th Avenue North, Saskatoon, SK (CA) S7K 6Z3; Chad Martinson, North Regina Residence, 3737Wascana Parkway, Regina, SK (CA) S4S 0A2

( * ) Notice: Subject to any disclaimer, the term of this patent is extended or adjusted under 35 U.S.C. 154(b) by 0 days.

(21) Appl. No.: 11/734,893

(22) Filed: Apr. 13, 2007

(65) Prior Publication Data

US 2007/0243945 A1 Oct. 18, 2007

(30) Foreign Application Priority Data

Apr. 13, 2006 (CA) ..... 2543509

(51) Int. Cl.
*A63B 53/14* (2006.01)
*A63B 57/00* (2006.01)

(52) U.S. Cl. ..... 473/285

(58) Field of Classification Search ..... 473/282–286, 473/406

See application file for complete search history.

(56) References Cited

U.S. PATENT DOCUMENTS 2,178,872 A * 11/1939 Engstrom ..... 473/285
2,979,335 A * 4/1961 Pruitt ..... 473/285
D266,445 S * 10/1982 Yokotaki ..... D21/718
4,858,925 A 8/1989 DeStefano, Jr.
5,087,044 A * 2/1992 Okushima ..... 473/285
5,277,425 A * 1/1994 Petriano, Sr. ..... 473/286
5,282,616 A * 2/1994 Stacavich-Notaro ..... 473/406
5,351,949 A * 10/1994 Fox et al. ..... 473/285
5,377,977 A 1/1995 MacNeary
5,690,558 A * 11/1997 Huber ..... 473/285
D395,068 S 6/1998 George
6,558,270 B2 5/2003 Kwitek
2002/0008393 A1* 1/2002 Nadratowski et al. ..... 294/19.2
2006/0264267 A1* 11/2006 Fox ..... 473/300
2007/0060412 A1* 3/2007 Penton ..... 473/285
2008/0230435 A1* 9/2008 Cope ..... 206/579

FOREIGN PATENT DOCUMENTS

JP 2000051415 A * 2/2000
JP 2004357925 A * 12/2004

* cited by examiner

*Primary Examiner*—Stephen L. Blau
(74) *Attorney, Agent, or Firm*—Standley Law Group LLP

(57) ABSTRACT

A grip for a golf club and a golf club is provided. The grip has an elongate gripping handle defining a cavity sized to surround an end of a shaft of a golf club. An end surface of the grip is provided with a magnet recessed into the end surface. A ball marker having a magnetic material is magnetically held in place on the end surface by the magnet. A ridge partially defines an outline of the ball marker so that the ridge at least partially surrounds the ball marker when the ball marker is positioned on the end surface, holding the ball marker in place on the end surface of the grip of a golf club when the ball marker is not needed.

14 Claims, 6 Drawing Sheets

GOLF CLUB HANDLE GRIP WITH BALL MARKER

CROSS-REFERENCE TO RELATED APPLICATIONS

This application claims foreign priority based upon Canadian Patent Application Serial No. 2,543,509, filed Apr. 13, 2006, the content of which is incorporated by reference as if fully recited herein.

TECHNICAL FIELD

This invention is in the field of accessories for golf clubs and more particularly to a putter grip adapted to hold a ball marker.

BACKGROUND

In the game of golf, once a person has landed their ball on the green, the game is played with a putter. The putter has a special head for contacting the ball which is connected to a shaft and on the end of the shaft is a putter grip allowing a person to grip the putter firmly. Since the invention of the first golf putter, putter grips have been used. Throughout the years they have changed in composition, materials and overall shape, but still remain similar to the original ones used. The putter grip is adhered to the end of the shaft of the putter and allows a player to grip the putter.

Typically, the game of golf is played with a number of players, which often results in a number of players being on a green at the same time and all putting on the green. To prevent one player from hitting another player's ball when they are on a green, ball markers are commonly used to mark the spot where a player has a ball on the green so that another player does not knock the first player's ball out of place when he or she putts. A player will place a ball marker (typically a relatively flat marker) on the ground where his or her ball lies and will then pick up the ball marker until it his or her time to putt. When it is the player's turn to putt, the player will place their ball back on the spot marked with the ball marker and then play their ball.

However, in order to use a ball marker to mark a player's position on a green, a player must carry a ball marker or have one handy. It is desirable to have a ball marker handy when it is needed.

United States Patent Application Publication 2006/0264267 to Fox discloses a grip for a golf club such as a putter, with a magnet contained within the end of the grip. It discloses storing a ball marker on the side of the grip by using the magnet to magnetically hold the ball marker against the grip when the ball marker is not in use. However, the ball marker is simply placed on the outside of the grip where it can easily come in contact with other objects and be brushed off, such as when a player is using the golf club to putt. Even if the ball marker is not knocked off of the grip when a player is putting, because it is exposed on the side of the grip, it can still snag clothing or an arm of a user making it a nuisance or even interfering with a player's putt.

It is desirable to provide a grip for a golf club with a place to carry a ball marker that is handy when a player is putting and yet still somewhat secure so that the ball marker will not be knocked off easily or impede a player putting with the golf club.

SUMMARY OF THE INVENTION

It is an object of the present invention to provide a grip for a golf club and a golf club that overcomes problems in the prior art.

In a first aspect, a grip for a golf club is provided. The grip comprises: an elongate gripping handle defining a cavity sized to surround an end of a shaft of a golf club; a first end having an opening to the cavity, the opening sized to accept the end of the shaft of the golf club; a second end having an end surface; a magnet recessed into the end surface and operative to magnetically hold a ball marker having a magnetic material, in place on the end surface; and a ridge at least partially enclosing a contact area on the end surface such that the ridge abuts a portion of an edge surface of the ball marker when the ball marker is positioned on the end surface.

In a second aspect, a golf club is provided. The golf club has a shaft, a head on a first end of the shaft, a grip on a second end of the shaft. The grip comprises: an elongate gripping handle with cavity sized to surround an end of a shaft of a golf club; a first end having an opening to the cavity, the opening sized to accept the end of the shaft of the golf club; a second end having an end surface; a magnet recessed into the end surface and operative to magnetically hold a ball marker having magnetic material, in place on the end surface; and a ridge at least partially enclosing a contact area on the end surface such that the ridge partially surrounds the ball marker when the ball marker is positioned on the end surface.

In an embodiment, a golf grip for a golf club and particularly a putter is provided. A magnet is provided recessed into an end surface of the grip with a ridge extending above the end surface and partially enclosing a contact area on the end surface of the grip. A magnet is provided recessed into the end surface within the contact area.

A ball marker, made of a magnetic material, can be positioned on the end surface of the grip in the contact area that is partially enclosed by the ridge, where it will be held in place by the magnet. With the contact area partially defined by the ridge and shaped to substantially conform to the shape of the ball marker, the ball marker is held relatively securely on the end surface of the grip and the ridge serves to prevent the ball marker from impeding the use of the putter or being knocked out of its position on the end surface by coming into contact with other objects.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
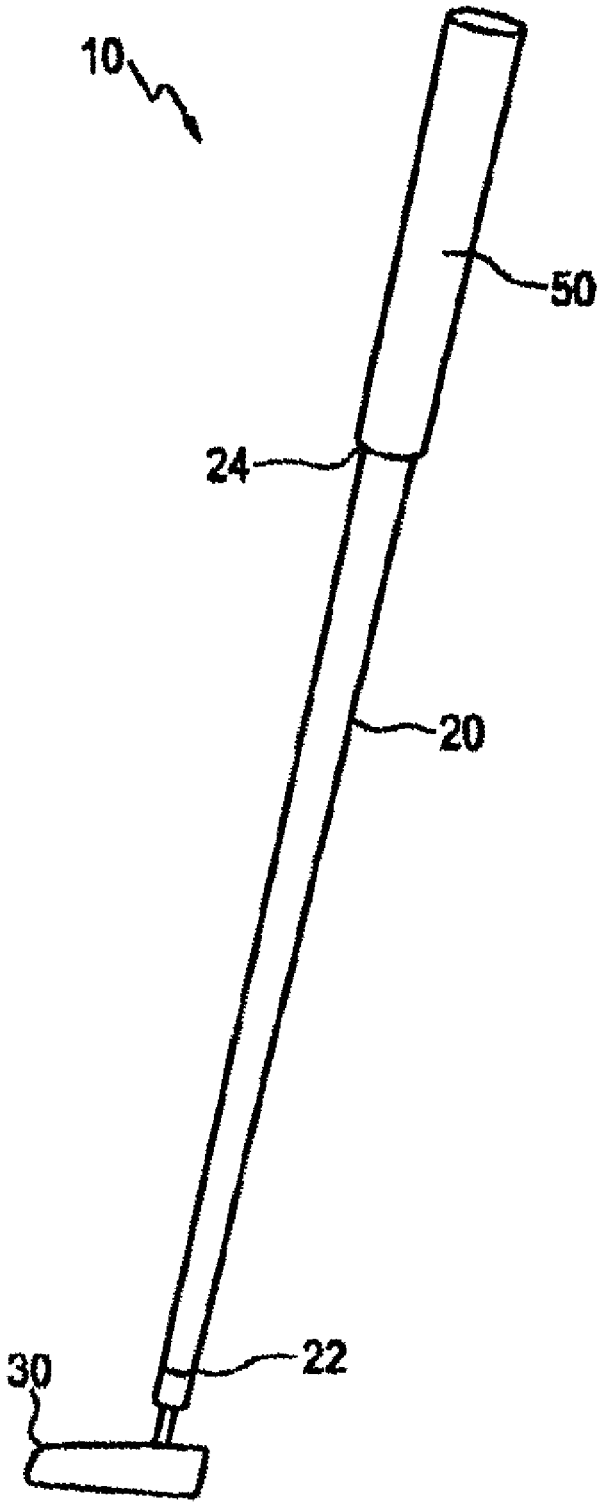
FIG. 1 is perspective view of a golf club containing a grip.

FIG. 1 is a perspective view of a golf club 10. The golf club is typically a putter that a player would use when his or her ball is on the green. The golf club 10 comprises: a shaft 20, with a first end 22 and a second end 24; a head 30 attached to the first end 22 of the shaft 20; and a grip 50 covering the second end 24 of the shaft 20.

Figure 2:
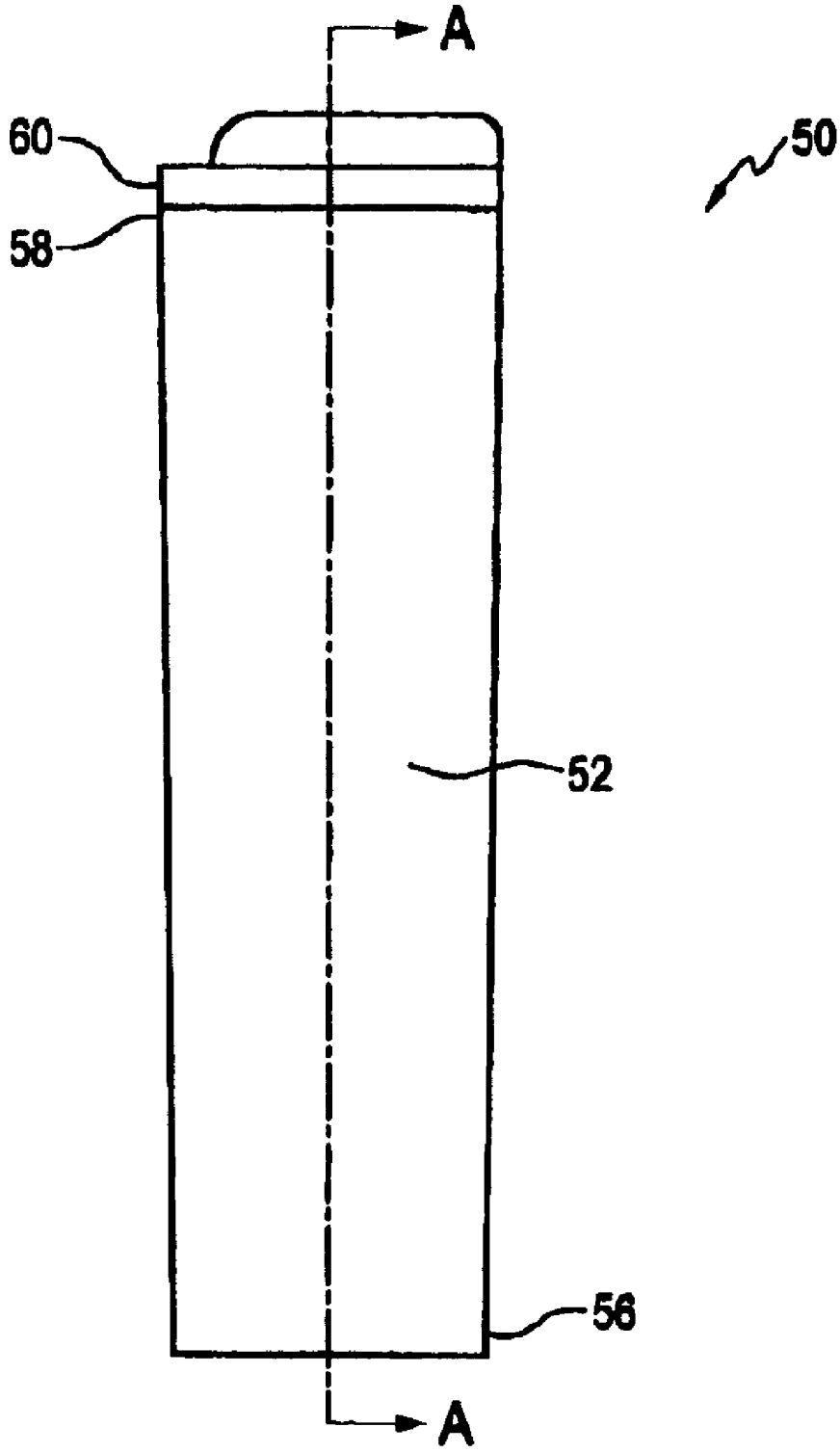
FIG. 2 is a side view of a grip adapted to hold and store a ball marker.

FIG. 2 is a side view of the grip 50. The handle portion 52 is typically formed of a flexible, relatively high-friction material to allow a player to easily and firmly grasp the grip 50.

Figure 3:
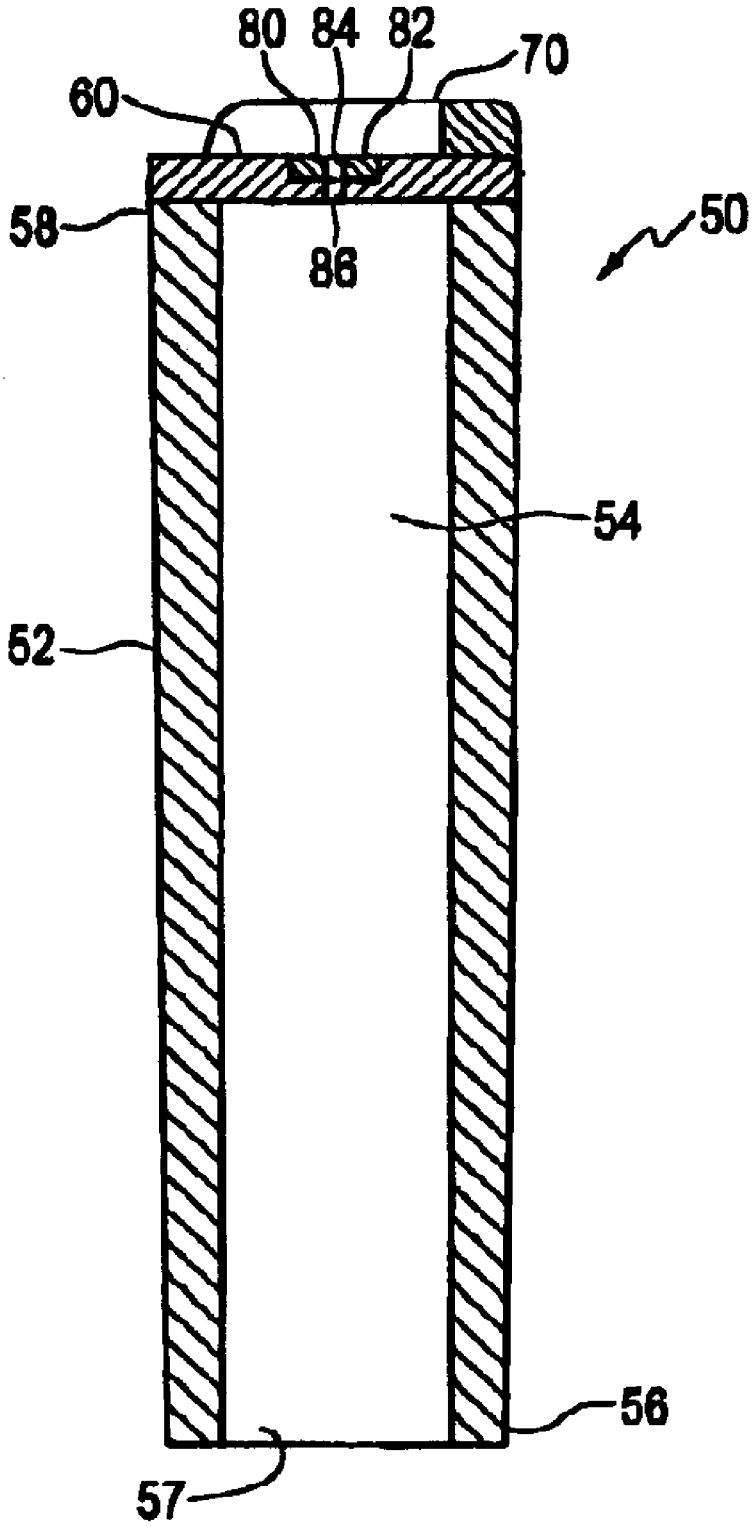
FIG. 3 is a sectional view of a the grip shown in FIG. 2.

FIG. 3 illustrates a cross-sectional view of the grip 50 along sectional line A-A in FIG. 2. Grip 50 defines a hollow body portion or cavity 54 which is sized to accept an end of a shaft of a golf club (typically a putter). A first end 56 of the grip 50 has an opening 57 allowing the shaft of the golf club to pass through the opening 57 and into the cavity 54 defined by the grip 50. On a second end 58, an end cap or end surface 60 is provided.

Figure 4:
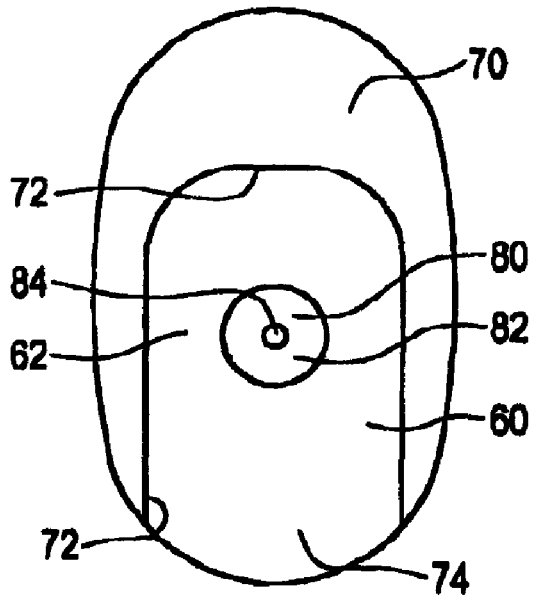
FIG. 4 is a top view of an end surface of the grip shown in FIG. 2.
Figure 5:
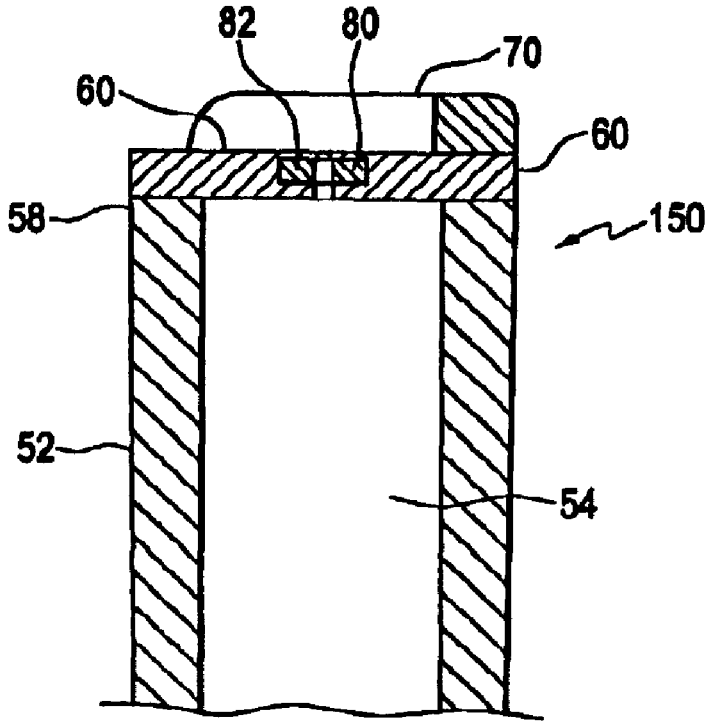
FIG. 5 is a sectional view of a grip in a further aspect.

FIG. 4 illustrates top view of end surface 60 of the grip 50. A magnet 80 is recessed into the end surface 60 such that a top surface 82 of the magnet 80 does not protrude above the end surface 60. Referring again to FIG. 3, magnet 80 is recessed into the end surface 60 such that the top surface 82 of the magnet 80 is flush with the end surface 60. FIG. 5 is a cross-sectional view of a grip 150 in a second aspect, where magnet 80 is recessed into the end surface 60 such that a top surface 82 of the magnet 80 is covered with a thin layer of material separating the top surface 82 of the magnet 80 from the end surface 60.

Referring again to FIG. 4, in an aspect, the magnet 80 is ring-like or annular in shape. The annular shape of the magnet 80 defines an aperture 84 in the center of the magnet 80. Referring to FIG. 3, the aperture 84 defined by the magnet 80 substantially aligns with an aperture 86 in the bottom of the recess in the end surface 60. Together, aperture 84 in the magnet 80 and aperture 86 in the recess in the end surface 60 form a passageway into the cavity 54 defined by the grip 50, which allows air to escape from the grip 50 when it is placed on the end of a shaft of golf club (not shown).

Figure 6:
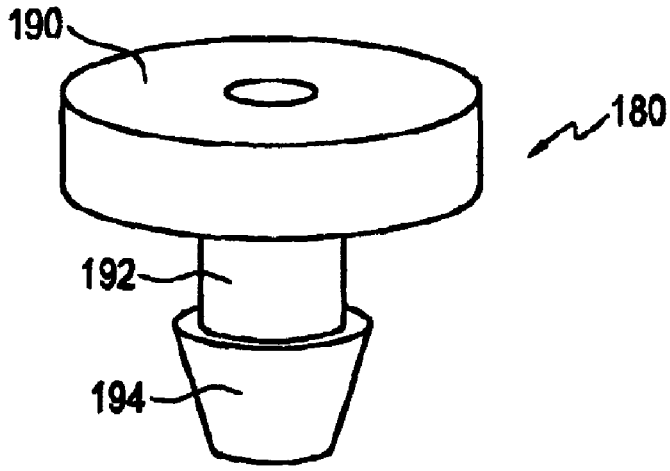
FIG. 6 is a side view of a magnet in a second aspect.

FIG. 6 illustrates a second aspect of a magnet 180 in a perspective view. Magnet 180 has a top portion 190 which is annular in shape and formed of a magnetic material and lower portion with an elongate cylindrical portion 192 and a tab 194.

Figure 7:
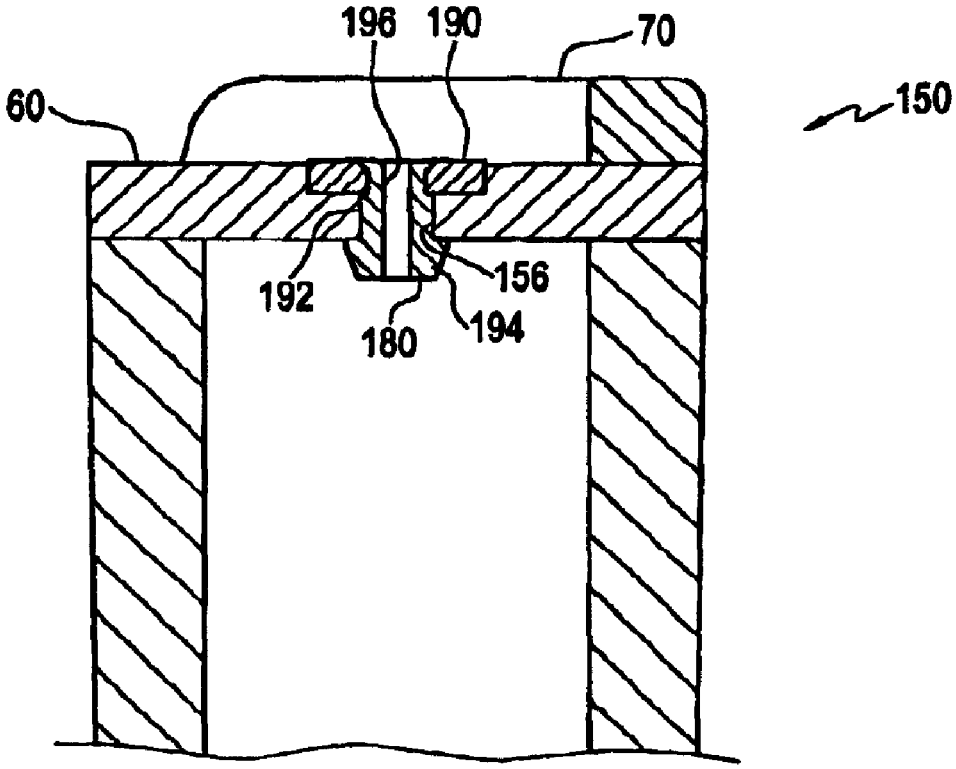
FIG. 7 is a sectional view of a grip with the magnet of FIG. 6.

FIG. 7 illustrates a sectional view of a grip 150 with magnet 180 secured in a recess in the end surface 60. The elongate cylindrical portion 192 has a length approximately equal to the depth of aperture 156 in the end surface 60, allowing the magnet 180 to be inserted into a recess in the end surface 60 with the cylindrical portion 192 and tab 194 extending through the aperture 156 with the tab 194 keeping the magnet 180 secured in the aperture 156, either with or without the use of additional adhesive. An aperture 196 in the magnet 180 passes into the internal cavity 54 of the grip 150.

Referring again to FIG. 4, a ridge 70 is provided on the end surface 60 and extending above the end surface 60. The ridge 70 partially surrounds a contact area 62 on the end surface 60 such that the contact area 62 is partially enclosed by the ridge 70, with inside surfaces 72 of the ridge 70 partially surrounding the contact area 62. Additionally, ridge 70 defines an opening 74 on one end of the contact area 62.

Figure 8:
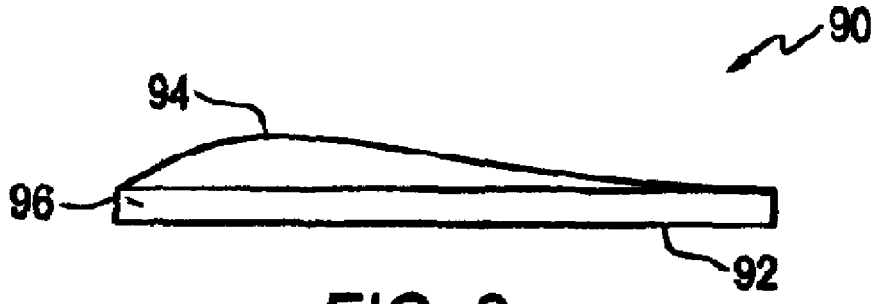
FIG. 8 is a side view of a ball marker.
Figure 9:
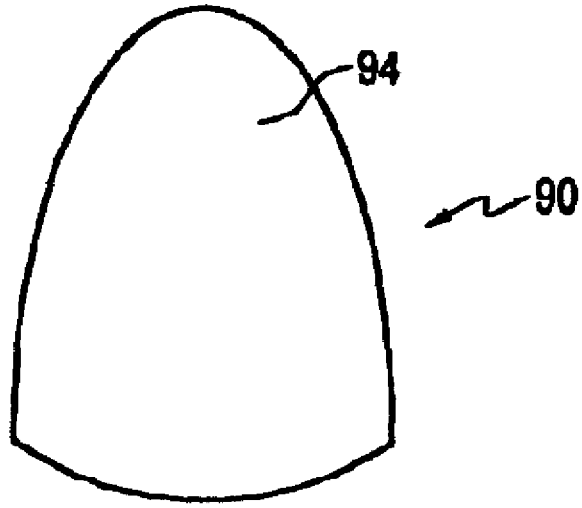
FIG. 9 is a top view of the ball marker of FIG. 8.

FIGS. 8 and 9 illustrate a side view and a top view of a ball marker 90, respectively. The ball marker 90 has: a bottom surface 92; a top surface 94; and an edge surface 96, encircling the ball marker 90. Ball marker 90 is made of a magnetic material and is sized and shaped to substantially match the contact area 62 on the end surface 60 partially defined by the ridge 70, shown in FIG. 4. In one aspect, the top surface 94 is an epoxy dome that covers the entire top surface 94 of the ball marker 90. Although FIG. 9 illustrates the ball marker 90 having a shield-like shape, it will be apparent to a person skilled in the art that ball marker 90 could be made in a number of different shapes.

Referring to FIGS. 8, 9 and 4, the grip 50 can store the ball marker 90 in place on the end surface 60 when the ball marker 90 is not needed to mark the spot where a player's ball is on a green. The ball marker 90 can be positioned in the contact area 62 defined by the ridge 70 on the end surface 60, where the magnet 80 then holds the ball marker 90 in place against the end surface 60. The ridge 70 abuts the edge surface 96 at a back part of the ball marker 90 and the ridge 70 extends along the edge surface 96 on the sides of the ball marker 90 preventing the ball marker 90 from sliding back against the ridge 70 or moving laterally from side to side.

By making the ridge 70 extend above the top surface 94 of the ball marker 90, the ball marker 90 can be protected from being jostled or knocked out of place when it the ball marker 90 is in position on the end surface 60.

To remove the ball marker 90 from its position in the contact area 62 partially defined by the ridge 70 on the end surface 60 of the grip 50, the ball marker 90 can simply be pulled off the end surface 60 overcoming the magnetic force imposed by the magnet on the ball marker 90. Alternatively, a user can slide the ball marker 90 through the opening 74 defined by the ridge 70 until the magnet 80 is no longer able to exert enough magnetic force on the ball marker 90 to hold the ball marker 90 against the end surface 60.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A grip for a golf club, the grip comprising:

an elongate gripping handle defining a cavity sized to surround an end of a shaft of a golf club, said handle having a first end having an opening to the cavity sized to accept the end of the shaft of the golf club; and a second end having an end surface;

a magnet recessed into the end surface of the grip and operative to magnetically hold a ball marker having a magnetic material in place on the end surface of the grip, the magnet being annular and having an aperture therethrough which will substantially mate with an aperture in the end surface of the grip, wherein the aperture in the magnet and the aperture in the end surface of the grip form a passageway into the cavity in the grip;

an elongate member extending below the bottom surface of the magnet with a flared flange positioned at the end thereof, an elongate hollow extending through the elongate member and the flange and also through the aperture of the magnet, whereby the elongate member passes through the aperture in the end surface of the grip and the magnet is held in place in the recess on the end surface of the grip by the elongate member and the flange; and a ridge at least partially enclosing a contact area on the end surface such that the ridge abuts a portion of an edge surface of the ball marker when the ball marker is positioned on the end surface.

2. The grip of claim 1 wherein the ridge extends above a top surface of the ball marker, when the ball marker is positioned on the end surface and held in place by the magnet.

3. The grip of claim 2 wherein the ridge abuts the edge surface of the ball marker, such that the ball marker is partially surrounded by the ridge when the ball marker is positioned on the end surface of the grip and held in place by the magnet, such that lateral motion of the ball marker when the ball marker is positioned on the end surface is substantially prevented by the ridge.

4. The grip of claim 3 wherein the ridge further defining an opening along one edge of the ball marker, the opening wide enough that the ball marker can pass through the opening, such that the ball marker can be removed from the end surface by sliding the ball marker through the opening.

5. The grip of claim 2 wherein at least half of the ball marker is surrounded by the ridge when the ball marker is positioned on the end surface and held in place by the magnet.

6. The grip of claim 1 further comprising a ball marker having a plurality of side edges and shaped to conform to the contact area at least partially defined by the ridge such that when the ball marker is placed in position on the end surface and held in place by the magnet, an inner surface of the ridge abuts at least a portion of the side edges substantially preventing lateral motion of the ball marker.

7. The grip of claim 1 wherein the magnet is recessed in the end surface such that a top of the magnet is uncovered by a material forming the end surface.

8. A golf club comprising:

a shaft;

a head on a first end of the shaft;

a grip on a second end of the shaft, the grip comprising:

an elongate gripping handle defining a cavity sized to surround the second end of the shaft, said handle having a first end having an opening to the cavity sized to accept the end of the shaft of the golf club; and a second end having an end surface;

a magnet recessed into the end surface of the grip and operative to magnetically hold a ball marker having magnetic material in place on the end surface of the grip, the magnet being annular and having an aperture therethrough which will substantially mate with an aperture in the end surface of the grip, wherein the aperture in the magnet and the aperture in the end surface of the grip form a passageway into the cavity in the grip;

an elongate member extending below the bottom surface of the magnet with a flared flange positioned at the end thereof, an elongate hollow extending through the elongate member and the flange and also through the aperture of the magnet, whereby the elongate member passes through the aperture in the end surface of the grip and the magnet is held in place in the recess on the end surface of the grip by the elongate member and the flange; and a ridge at least partially enclosing a contact area on the end surface such that the ridge abuts the ball marker when the ball marker is positioned on the end surface.

9. The golf club of claim 8 wherein the ridge extends above a top surface of the ball marker, when the ball marker is positioned on the end surface and held in place by the magnet.

10. The golf club of claim 9 wherein the ridge abuts the edge surface of the ball marker, such that the ball marker is partially surrounded by the ridge when the ball marker is positioned on the end surface of the grip and held in place by the magnet, such that lateral motion of the ball marker when the ball marker is positioned on the end surface is substantially prevented by the ridge.

11. The golf club of claim 10 wherein the ridge further defining an opening along one edge of the ball marker, the opening wide enough that the ball marker can pass through the opening, such that the ball marker can be removed from the end surface by sliding the ball marker through the opening.

12. The golf club of claim 9 wherein at least half of the ball marker is surrounded by the ridge when the ball marker is positioned on the end surface and held in place by the magnet.

13. The golf club of claim 8 further comprising a ball marker having a plurality of side edges and shaped to conform to the contact area at least partially defined by the ridge such that when the ball marker is placed in position on the end surface and held in place by the magnet, an inner surface of the ridge abuts at least a portion of the side edges substantially preventing lateral motion of the ball marker.

14. The golf club of claim 8 wherein the magnet is recessed in the end surface such that a top of the magnet is uncovered by a material forming the end surface.

* * * * *

UNITED STATES PATENT AND TRADEMARK OFFICE

CERTIFICATE OF CORRECTION

PATENT NO. : 7,658,682 B2
APPLICATION NO. : 11/734893
DATED : February 9, 2010
INVENTOR(S) : Hoium et al.

It is certified that error appears in the above-identified patent and that said Letters Patent is hereby corrected as shown below:

On the Title Page,

Item (76) - Inventors please delete

"Chad Martinson, North Regina Residence, 3737 Wascana Parkway, Regina, SK (CA) S4S 0A2"

Signed and Sealed this
Thirteenth Day of March, 2012

David J. Kappos

David J. Kappos
*Director of the United States Patent and Trademark Office*